United States Patent [19]

Pongrass et al.

[11] Patent Number: 4,903,738

[45] Date of Patent: Feb. 27, 1990

[54] JACQUARD EMULATOR

[75] Inventors: Robert G. Pongrass; Mark A. Buchen, both of Chippendale, Australia

[73] Assignee: Wilcom Pty. Ltd., Australia

[21] Appl. No.: 325,134

[22] Filed: Mar. 16, 1989

Related U.S. Application Data

[63] Continuation-in-part of Ser. No. 3,407, filed as PCT AU86/00105 on Apr. 18, 1986, published as WO86/06421 on Nov. 6, 1986, abandoned.

[30] Foreign Application Priority Data

Apr. 19, 1985 [AU] Australia ..... PH00207

[51] Int. Cl.[4] ..... D03C 19/00

[52] U.S. Cl. ..... 139/317; 139/68; 139/59

[58] Field of Search ..... 139/317, 318, 319, 59, 139/68; 264/470; 66/205, 206, 207

[56] References Cited

U.S. PATENT DOCUMENTS

| | | | |
|---|---|---|---|
| 3,828,826 | 8/1974 | Hurzeler | 139/59 |
| 4,059,131 | 11/1977 | Bucher | 139/59 |
| 4,134,432 | 1/1979 | Stauner | 139/59 |
| 4,416,310 | 11/1983 | Sage | 139/65 |
| 4,527,597 | 7/1985 | Yoshida et al. | 139/68 |
| 4,532,963 | 8/1985 | Bastion et al. | 139/59 |
| 4,566,499 | 1/1986 | Kitagawa et al. | 139/59 |

FOREIGN PATENT DOCUMENTS

| | | |
|---|---|---|
| 88520 | 9/1982 | Australia . |
| 313906 | 7/1919 | Fed. Rep. of Germany . |
| 1320279 | 6/1987 | U.S.S.R. . |
| 130468 | 1/1973 | United Kingdom . |

*Primary Examiner*—Henry S. Jaudon

*Attorney, Agent, or Firm*—Kirschstein, Ottinger, Israel & Schiffmiller

[57] ABSTRACT

A Jacquard emulator for operating the pins of a Jacquard mechanism as is used in the textile industry. The emulator has a number of disks mounted on the shafts of respective stepper motors. The disks have a number of holes therein so that when the disks are brought into contact with the pins by axial movement, predetermined pins align with holes in the disk so that required patterns of pins are actuated. The stepper motors are controlled to orient the disk to vary the pattern of pins actuated as required by a desired program.

6 Claims, 9 Drawing Sheets

JACQUARD EMULATOR

CROSS-REFERENCE TO RELATED APPLICATIONS

This application is a continuation-in-part of pending application Ser. No. 3,407, filed as PCT AU86/00105 on Apr. 18, 1986, published as WO86/06421 on Nov. 6, 1986, now abandoned.

TECHNICAL FIELD

This invention relates to a device for replacing or emulating Jacquard card or Jacquard paper tape on machines using a Jacquard mechanism as is used extensively throughout the textile industry such as the Staubli Dobby machine.

BACKGROUND ART

The term "Jacquard mechanism" is used to describe a system of mechanical decoding developed in the 1800's by Monsieur Jacquard. This type of mechanical decoding has been and still is, used extensively in the textile industry to control various machines such as weaving machines and embroidery machines.

The principle of operation of the Jacquard mechanism is as follows. The weaving or embroidery pattern (as the case may be) is encoded on a Jacquard card as a series of holes at predetermined locations (a Jacquard card is a giant paper tape made from cardboard). The hole locations are arranged in rows and columns across the card. This card is then interrogated by the Jacquard mechanism to determine the code and to operate the machine in accordance with the code detected. The interrogation is carried out by presenting a line of mechanical pins (needles or feelers) to a row of hole locations on the card. If the pins pass through the card, a "hole" is detected and if the pins do not pass through the card, a "no hole" is detected. The particular combination of "holes" and "no holes" determines the action taken by the machine during that machine cycle. After interrogation, the pins are withdrawn and the card is progressed one row and interrogated again to determine the code for the next step (or machine cycle) and so forth. For a further discussion on how a Jacquard mechanism or Dobby machine operates, the reader is directed to the following books:

"Embroidery Schiffli and Multihead" by Coleman Schneider; and

"An Introduction to Textile Mechanisms" by P. Grosberg 1986 (Ernest Benn Limited, London).

As will be appreciated, when a programme is repeated many times, the Jacquard card becomes worn by the interrogation of the Jacquard pins and a hole may appear where a "no hole" should be, creating a flaw in the pattern. At this stage, a new card is required to be punched to replace the worn out card. The Jacquard card has further disadvantages in that its sheer physical size creates storage problems as well as requiring special punching machines to produce replacement cards as they wear out. There are many machines in existence using a form of a Jacquard mechanism and industry has been looking at ways of increasing the speed of operation of these machines. Unfortunately, one of the factors limiting the speed of these machines is the speed at which the Jacquard card can be progressed to the next step for code reading and by the time required in loading and unloading the Jacquard card.

As can be seen, it is desirable to produce a device which can be used in place of the Jacquard card, to emulate the card and actuate the Jacquard mechanism in the same way as the Jacquard card. In the past, devices have been constructed to emulate the Jacquard cards so that down time is reduced and higher operating speeds may be attained. However, these devices also have had problems.

Solenoid emulators have been produced in which the "hole" or "no hole" in the paper tape is emulated by a plunger controlled by the solenoid to open or close a hole formed in a metal block which is presented to the Jacquard pins, the solenoids being controlled by electronic means to emulate the programme on a Jacquard card.

The solenoids, however, have a limited life cycle and in one programme, may operate many hundreds of times thus creating reliability problems through failure of a solenoid to operate which may not be noticed immediately resulting in a flaw in the final pattern produced. Also, the number of solenoids required make the detection of the failed solenoid difficult. When solenoids are nearing the end of their useful life, they tend to fail at a seemingly random occurrence.

A drum controller was proposed to emulate the paper tape. In this arrangement, the paper tape was replaced by a mechanism having a series of drums, each drum being independently rotatable and being rotated by respective stepper motors via gearing. The drums had holes therein to emulate the holes in the paper tape. The stepper motors were controlled electronically to rotate the drums to the required position having the same hole pattern as that part of the paper tape which was being emulated at that particular point in time. However, this proved to be unsatisfactory due to the closeness of the Jacquard pins, requiring the drums to be physically located very close together, and acceptable machining tolerances resulting in the drums rubbing on each other causing friction losses. Thus, the load on the drive motors was increased and their operational life, effectiveness and reliability was reduced. The relatively large inertia of the drums presented a speed limitation on the control of the drums both at the starting and stopping of the rotation of the drum. The allowable size of the motors was small due to the limited space available in the compact design of the device. Therefore, while the drum controller did overcome most of the disadvantages of the paper tape, it still had some disadvantages.

DISCLOSURE OF THE INVENTION

Thus, the object of this invention is to provide a mechanism that will emulate the code on a Jacquard card for operating machines using a Jacquard mechanism. The machines using a Jacquard mechanism often represent a large capital investment in a textile factory and replacement of the entire machine to improve efficiency usually is not commercially viable.

Accordingly, the present invention consists in apparatus for actuating predetermined patterns of pins in a Jacquard mechanism of a textile machine, said apparatus comprising:

at least one disk located on a shaft parallel to the axis of the pins such that the face of the at least one disk is adjacent the ends of the pins;

rotation means operable by control means to rotate the disk about the axis of the shaft to a desired orientation, the face of the disk being provided with holes arranged in predetermined locations.

Preferably, the rotation means comprises at least one stepping motor coupled to the at least one disk respectively.

Preferably, the at least one disk is fitted to the respective shaft for rotation therewith but movable therealong by the actuator.

Alternatively, the actuator is adapted to move the or each disk and the or each stepper motor as a unit.

Preferably, the control means includes sensing element for sensing the orientation of the or each disk.

Preferably, the control means comprises a microprocessor.

BRIEF DESCRIPTION OF THE DRAWINGS

Notwithstanding any other forms which may fall within the scope one preferred embodiment of the invention will now be described by way of example only with reference to the accompanying drawings, wherein.

MODES FOR CARRYING OUT THE INVENTION

Figure 1:
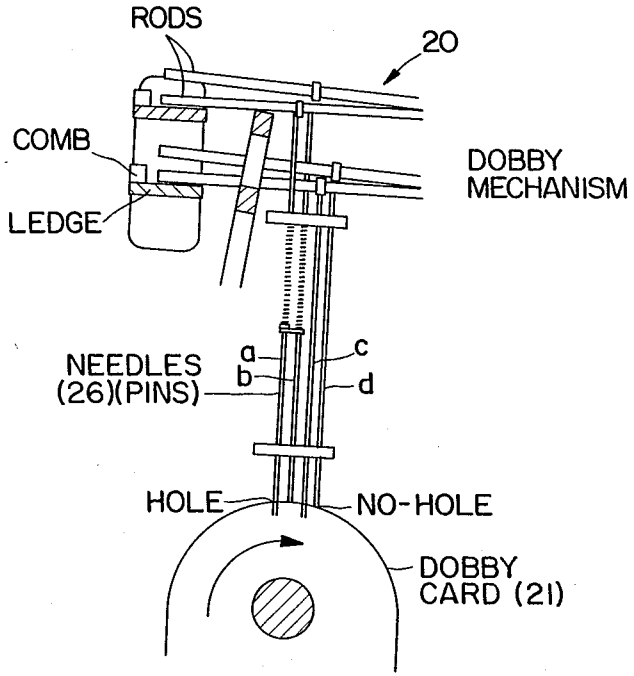
FIG. 1 illustrates a Dobby or Jacquard mechanism of a conventional Dobby machine showing 4 rows of pins interrogating a Jacquard card (Dobby card)
Figure 2:
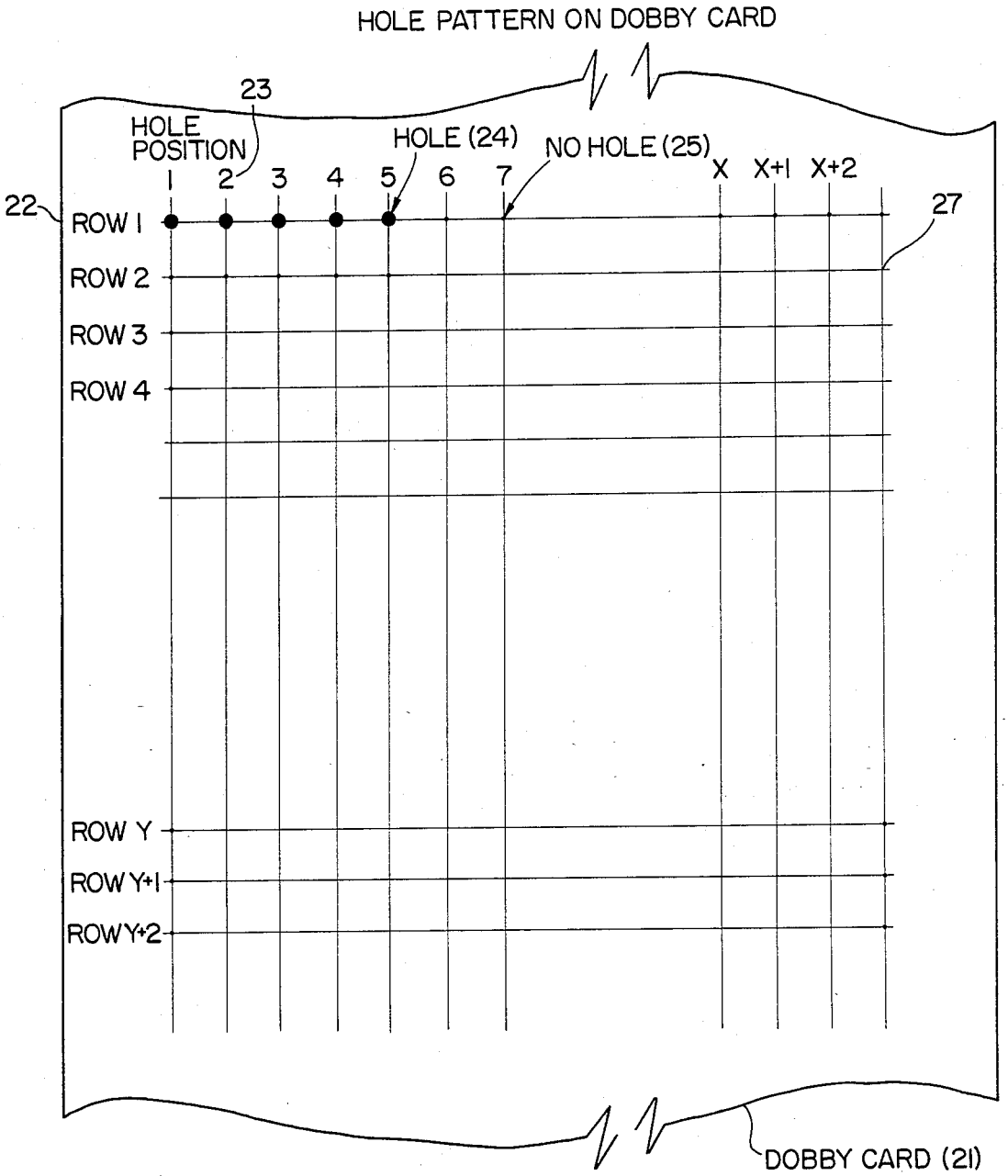
FIG. 2 illustrates a typical section from a Dobby card showing how the "holes" and "no holes" are arranged in rows and columns along the card.

The present invention will be described with reference to the Staubli Dobby. A Dobby mechanism is a particular type of Jacquard mechanism applied to textile weaving machines. The Staubli Dobby reads pattern information coded on a Dobby card (Jacquard card) 21 and converts that information to physical movements on a weaving machine. In this particular machine, the Dobby mechanism 20 as illustrated in FIG. 1 has four rows (a,b,c,d) of pins or feelers 26 used to interrogate the Dobby card 21. The Dobby card, as illustrated in FIG. 2, is a giant paper tape made from cardboard having holes 24 punched in rows 22 and columns 23 along the card. The code on the card is determined by whether or not a hole is punched in a particular hole position 27 along a row 22. As this particular Dobby mechanism has four rows of needles each row containing one needle per each hole position 27, four rows of information can be read or detected simultaneously by the sets of needles 21. Therefore, with every cycle of the Dobby, four rows of information are detected simultaneously by the sets of needles. Of this information, two needles read information for the pattern running in a forward direction, with the first row reading the next row to be executed, the second row reads the current row to be executed, the third row reads the row that has just been executed in the previous cycle, and the fourth row reads the row that has been executed in the cycle previous to that. Thus, it can be seen that the hole positions on a Dobby card can be described as a series of X,Y coordinates representing a matrix of positions 27. The third and fourth rows (c,d) of needles are used for when the machine is operating in reverse to undo steps previously taken.

If we accept the following generalized terminology:

y = number of the row of data along the length of the Dobby Card x = number of the hole position across the width of the Dobby card a = first row of needles across the Dobby mechanism;

b = second row of needles c = third row of needles d = fourth row of needles then in any cycle of the Dobby mechanism, at hole position x the following reading of holes will occur:

a(x) reads row y+1 b(x) reads row y c(x) reads row y−1 d(x) reads row y−2 where we consider row y to be the current row to be executed by the Dobby mechanism during the current cycle.

In mechanical terms, needle rows c and d act as a mechanical memory of the rows that have already been executed, such that if the machine is put into reverse motion in order to retrace the weaving steps then that information is readily available by engaging those needles.

Needles row a provides a priori information for the next row 22 to be executed thereby increasing the speed of the mechanism by having the information required for the next row to be executed already mechanically stored.

In terms of a Staubli-type Dobby mechanism, typical values are:

x = 15 to 30 hole positions

Y = 1 to 60 rows - called picks on a weaving machine

Therefore, if we assume that we are concerned with a Dobby which has 20 hole positions, i.e. x = 20, there will be 20 needles for each row of needles a,b,c,d such that at any time the Dobby card is being read during the execution of a cycle, there are 4×20 needles engaged in the Dobby card, i.e. 80 needles.

As will be readily apparent to persons with knowledge in the textile industry, the Dobby card 21 is read by the pins 26 of the Jacquard mechanism 20 interrogating the Dobby card by moving towards the card to read the line of information. If a particular pin 26 encounters a "hole" 24, the pin passes through the card and if a "no hole" 25 is encountered, the pin is prevented from moving any further by the card and it is the combination of holes and no holes which determines the particular code for that row 22. The actual operation of the Jacquard mechanism is well known and does not need to be further described here as the present invention is related to replacing the Jacquard card and is not concerned with the operation of the Jacquard mechanism per se.

Figure 10:
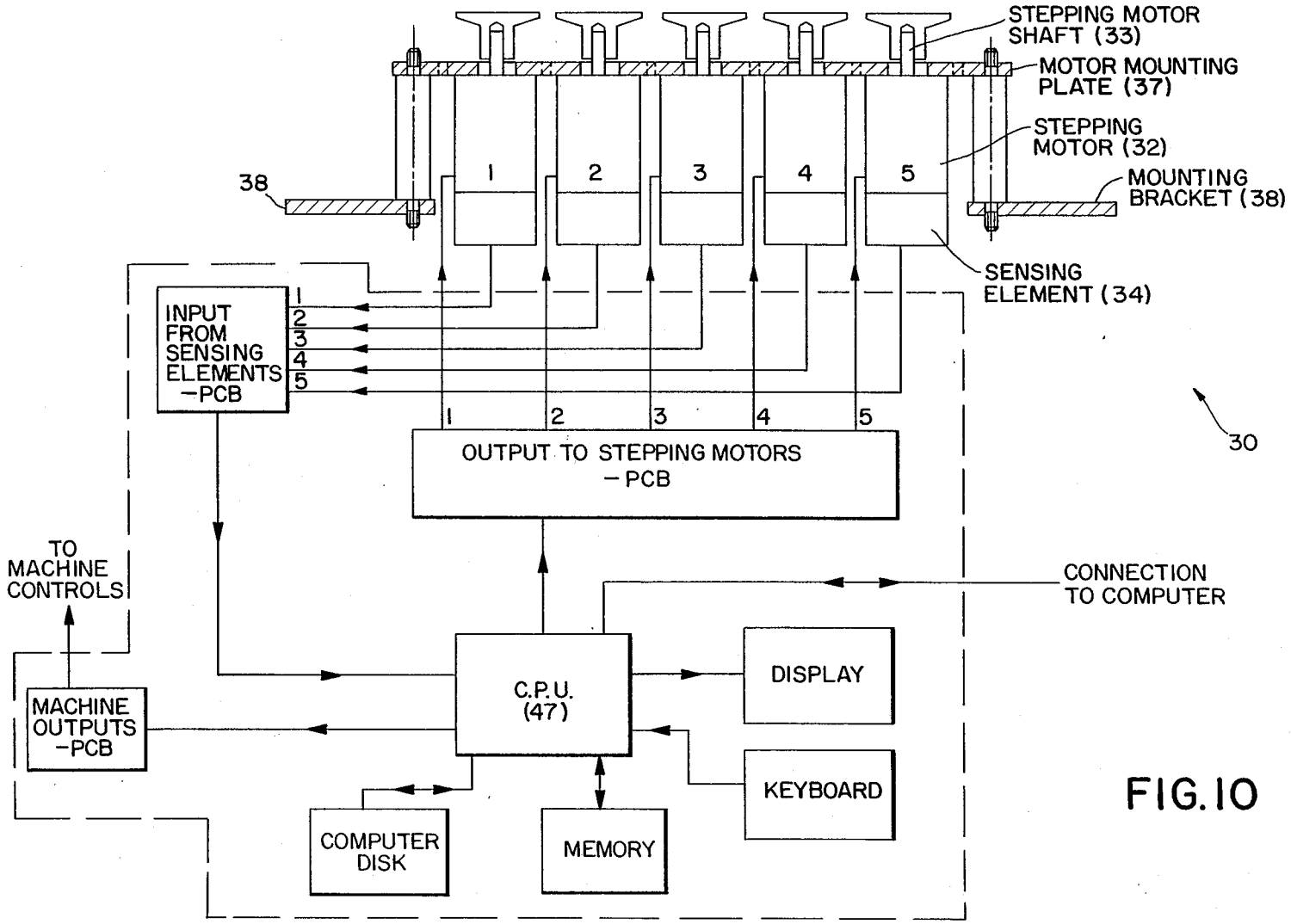
FIG. 10 is a schematic of the microprocessor controller of the Jacquard emulator.

The apparatus 30 of the present invention emulates the Dobby card by replacing the card with a series of disks 31 having a predetermined pattern of holes 24 thereon and rotated by stepping motors 32 controlled by a controller, preferably in the form of a microprocessor 40 (see FIG. 10). In operation, the disks are rotated to align predetermined patterns of holes with the Jacquard pins 26 of the Dobby machine. Although a Dobby mechanism 20 as previously described has four rows of needles for each hole position, for the purpose of the Jacquard emulator 30, only one row of needles is required for use, i.e. the Jacquard emulator uses only row b, the row reading the current data to be executed by the Dobby mechanism during the current machine cycle. The other rows of needles are physically removed such that they are not present and therefore, have no contact with the disks. Therefore, in the preferred embodiment, the Dobby mechanism has 20 possible hole positions and the Jacquard emulator provides hole or no hole position information for the 20 needles engaged in reading the data during the execution of the current cycle.

When the unwanted rows (a, b and c) of needles are removed, a slight modification is required to the Dobby mechanism 20. The mechanism operated by row a is physically combined to the row b pins and the reverse cam is modified so that when the Dobby machine is put into reverse direction, the machine and weaving move into reverse direction but the information required is transferred by the forward set of needles (now the only set of needles, row b) and the programme information is fed to the disk in the reverse direction to reverse the pattern. Previously, the Dobby machine read two rows of information at a time so that the current row was read by row b pins and the next row was read by row a pins which mechanically store that information until required by the machine. This allowed the tape to move two rows at a time to increase the speed of the mechanism. In the present embodiment, only one row is used requiring the disks to be read every half machine cycle. This does not slow down the machine due to high speed possible in orientating the disks for the next interrogation sequence (information transfer). This high speed actually allows higher machine speeds to be attained without sacrificing reliability.

As can be seen from the drawings, there are 5 disks 31 provided for operating the 20 pins, being 4 pins per disk. The row of needles is a straight row positioned along the common centre line of the disks. The number of needles allocated to each disk can be varied as a functional disk diameter. Typically, one disk could provide pattern data to suit 4 needles thus requiring 5 disks for a 20 hole position on Dobby machine as provided in the preferred embodiment.

Figure 3:
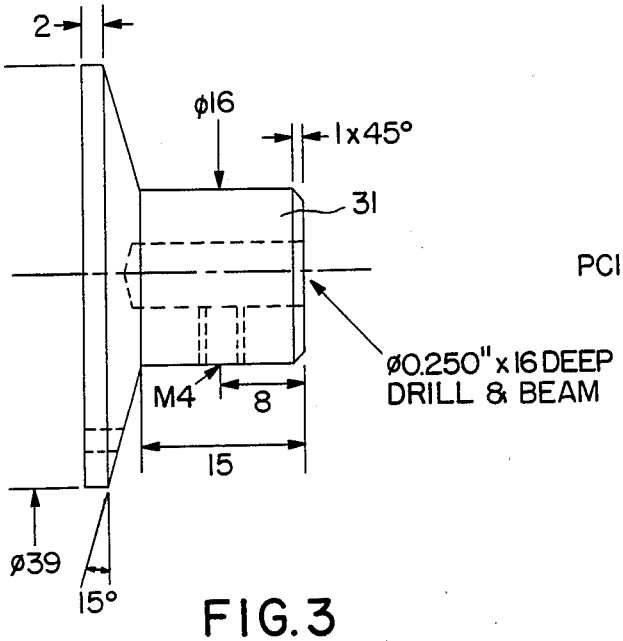
FIG. 3 is a side view of a disk forming part of the preferred embodiment of the Jacquard emulator.
Figure 4:
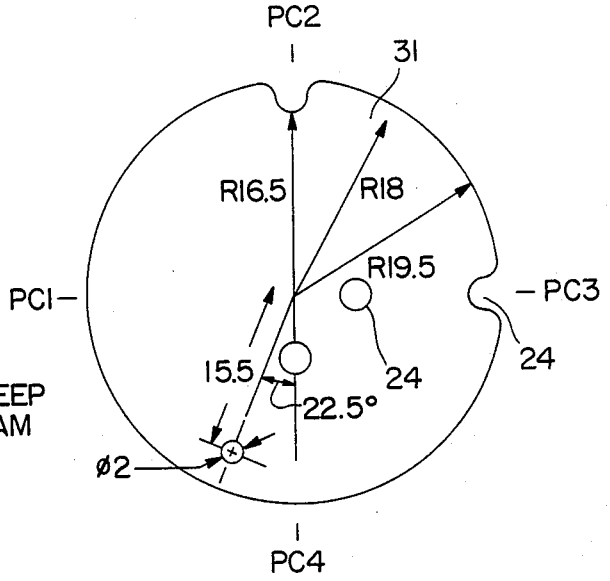
FIG. 4 is a view of the face of one disk of the preferred embodiment showing the configuration of holes and "no holes"
Figure 5:
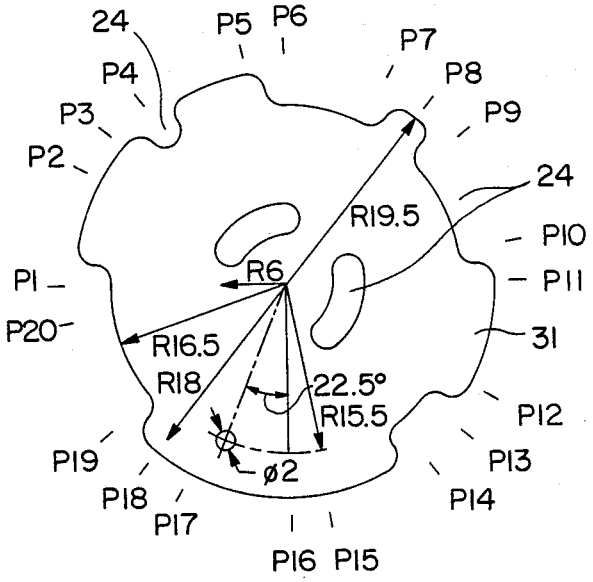
FIG. 5 is a similar view to FIG. 4 showing the typical configuration of 4 additional disks used in the preferred embodiment.

The construction of the preferred Jacquard emulator will now be described. The profile of the disks 31 are shown in FIG. 3 and of the 5 disks, there is one disk having a face configuration as shown in FIG. 4 and 4 disks having a face configuration as shown in FIG. 5. The holes formed near the edge of the disks are represented by gaps in the circumference of the disk. The holes formed near the centre of the disk and adjacent to another result in slots being created.

Figure 9:
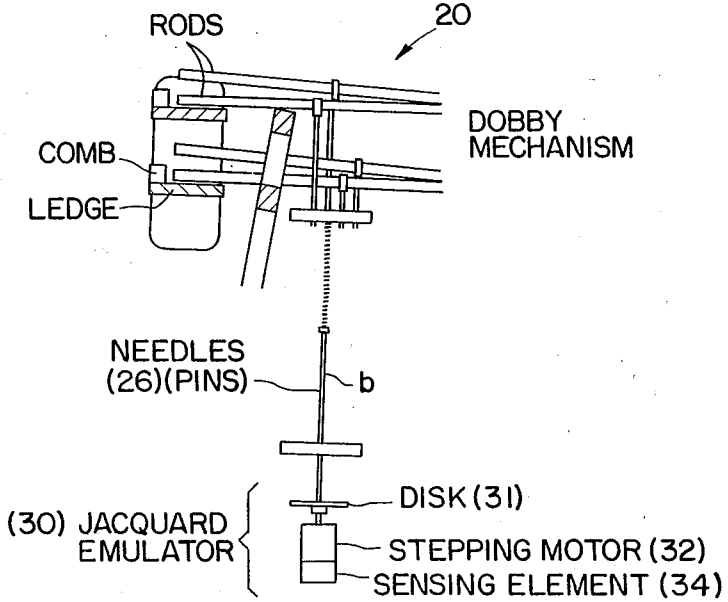
FIG. 9 illustrates how the Jacquard emulator replaces the Jacquard card on the Dobby mechanism shown in FIG. 1.
Figure 6:
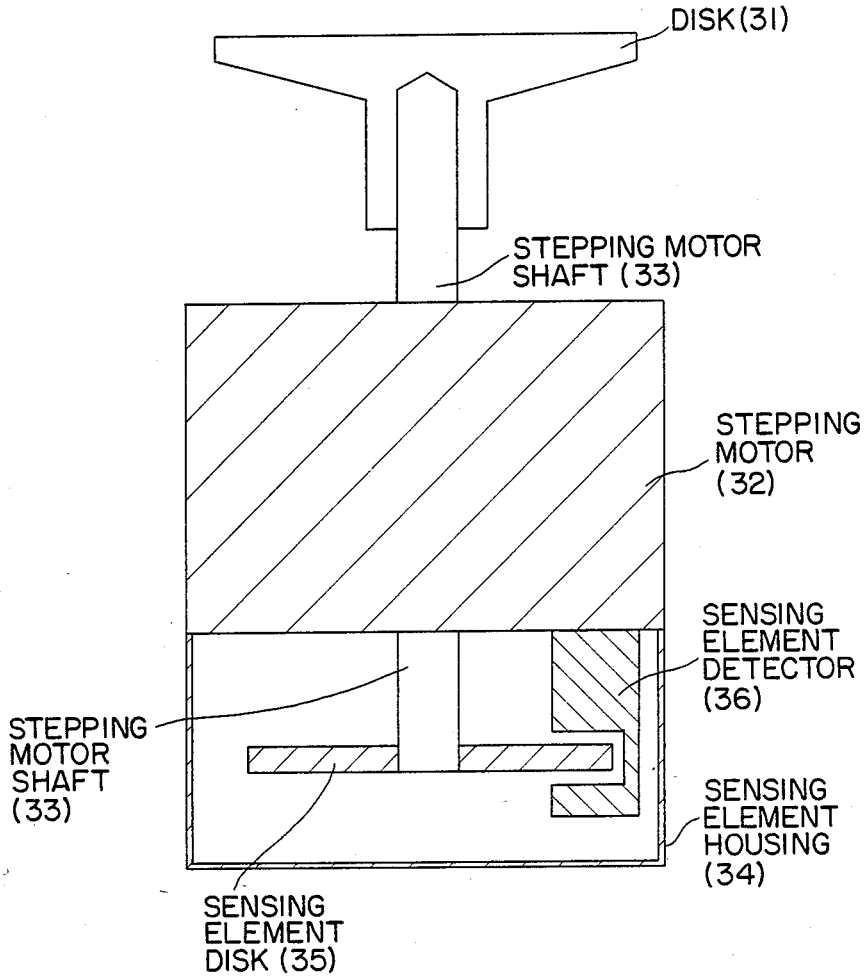
FIG. 6 illustrates the connection of the disk to a stepping motor and illustrating the construction of a disk orientation sensing element.
Figure 7:
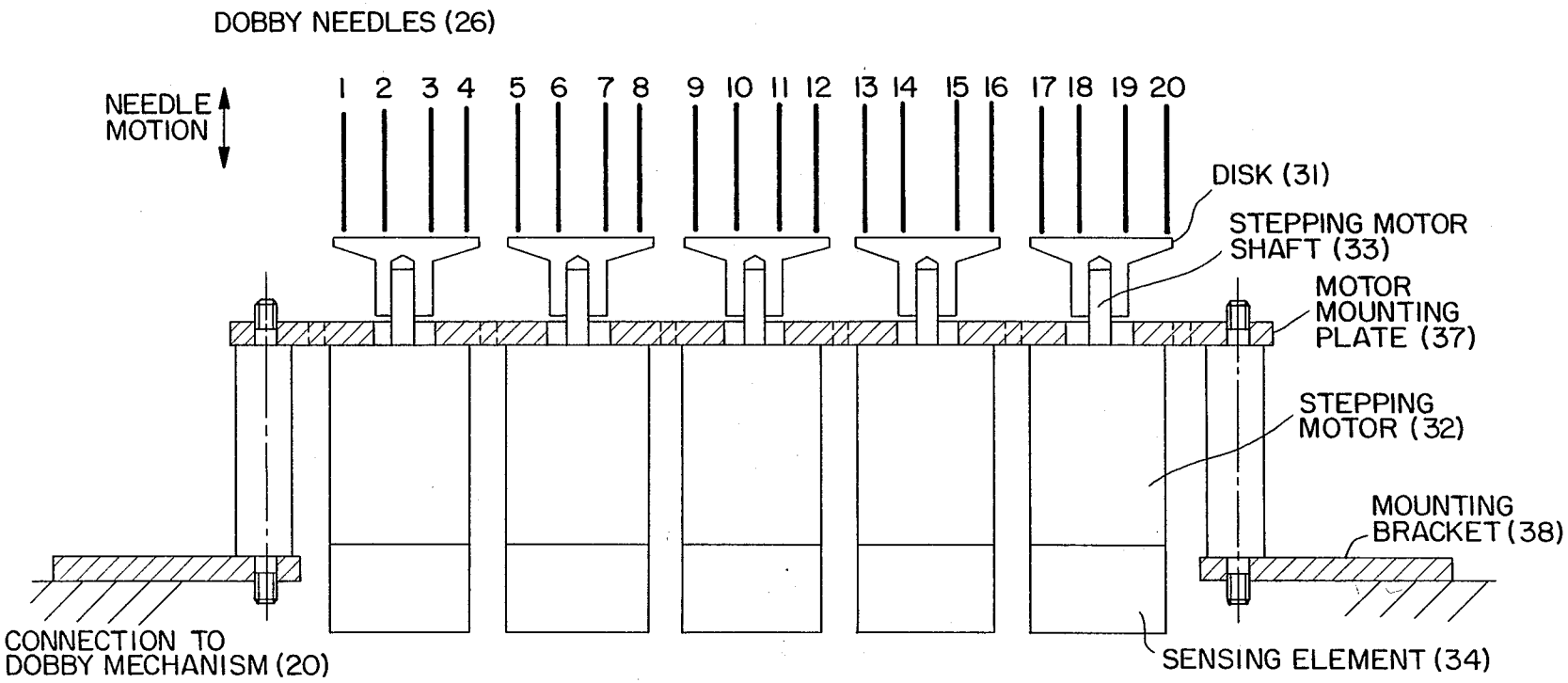
FIG. 7 shows the connection of the preferred embodiment having 5 disks and respective stepping motors connected to a 20-needle Jacquard mechanism Dobby machine.
Figure 8:
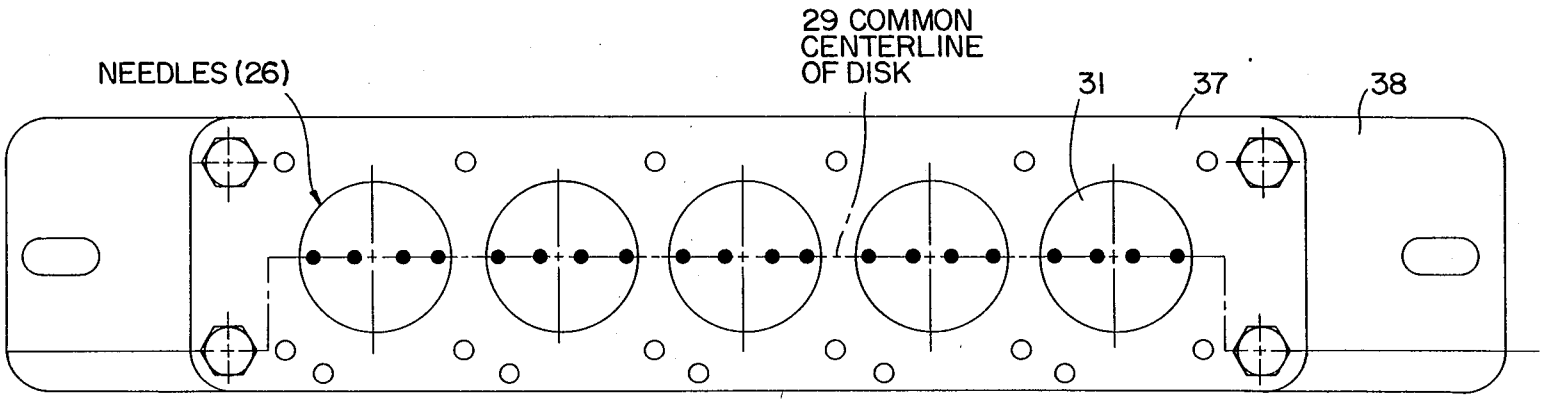
FIG. 8 is a view from above of the arrangement of FIG. 7.

As shown in FIG. 6, each disk 31 is mounted to one end of a shaft 33 of a stepping motor 33. The other end of the shaft of the stepping motor is fitted with a sensing element disk 35 which cooperates with a sensing element detector 36 for determining the orientation of the disk 31. The sensing element disk 35 and sensing element detector 36 are enclosed within a sensing element housing 34 fitted to the end of the stepping motor 32. Each stepping motor is bolted to a motor mounting plate 37, which is in turn bolted to a mounting bracket 38 fitted to the Dobby machine as shown in FIGS. 7 and 8. FIG. 9 illustrates how the Jacquard emulator 30 interacts with the Jacquard pins 26 of the Dobby mechanism 20. As can be seen from this figure, only pin row B is present with rows a, c and d having been removed. The disks 31 are aligned such that the straight row of needles or pins 26 are positioned along the common centre line 29 of the disks and the individual pins are arranged to be offset from the centre of their respective disks by a predetermined distance to be alignable with the holes provided therein.

The sensing element is an absolute encoder of the optical type where the sensing element disk 35 which provides the data for absolute position and coding is physically attached directly to the shaft 33 of the stepping motor 32. This is achieved through the use of a stepping motor with a double-ended shaft such that the disk 31 is attached at one end of the shaft and the sensing element disk 35 is attached to the other end. The sensing element detector 36 is mounted relative to the sensing motor and the sensing element housing 34 encloses the whole assembly. The alignment of the disk 31 and sensing element disk 35 is carried out during the assembly of the disk/motor/sensing element such that the zero position of the absolute encoding provided by the sensing element coincides with the zero position position on the disk 31.

As can be seen in FIG. 10, the stepping motors are controlled by a microprocessor 40 to orientate the disks in the desired combination of holes and no holes to form the code required for operating the Dobby machine. The microprocessor 40 has a CPU 47, a display 41, a keyboard 42, memory 43, computer disk drive 44, connection 46 for connecting to another computer, an output to the stepping motors, an input 48 from the sensing elements of the stepping motors and an output 45 to the Dobby machine controls.

The pattern data is stored on computer disks or may be transferred to the memory 43 from a separate computer through the computer connection 46. The pattern data, being a series of holes 24 on a Dobby card 21 is stored as electronic data. In the microprocessor, the pattern data is divided into the information which is relevant to each set of needles, for example, needles 1 to 4 are grouped together representing the information required for disk 1. Similarly, needles 5 to 8 are grouped for disk 2 etc. The holes represented by the pattern data for a set of needles on the particular disk are represented as binary data and each particular combination has a disk position associated with it. When the disk is rotated to that position by the stepping motor, the hole pattern presented by the disk to the needles will be equivalent to the desired pattern data originally presented by the Jacquard card. An example of this is as follows:

If we use 0 (zero) to represent "no hole" and 1 (one) to represent a "hole":

| | Needle 1 | Needle 2 | Needle 3 | Needle 4 | Disk Position |
|---|---|---|---|---|---|
| Pattern data | 0 | 0 | 0 | 0 | P1 |
| | 0 | 0 | 0 | 1 | P2 |
| | 0 | 0 | 1 | 0 | P3 |
| | 0 | 0 | 1 | 1 | P4 |
| | etc., | etc. | | | |

When the desired pattern for needles 1 to 4 is 0001, then the microprocessor converts this desired pattern into a Disk Position P2.

The microprocessor checks the sensing element for the stepping motor to determine the present position of the disk, compares it with the desired position and calculates the movement which the stepping motor must make to arrive at the new desired position.

When the stepping motor 32 has arrived at the desired position, the microprocessor 40 compares this to the information provided by the sensing element to ensure that the disk is in the correct position. If a correct position has not been achieved then the microprocessor may issue a stop signal or may make an adjustment to the stepping motor to move it to the correct position.

The microprocessor carries out the operation of converting pattern data to disk position and then doing the feedback positioning control for each and every set of disk/motor/sensing element combinations as required for the Jacquard emulator 30.

The display 41 is used to indicate information to the operator such as the name of the programme being run and the current status of the programme, i.e. starting, finished, or percentage of the pattern completed or displaying error messages. The keyboard 42 is used for interaction by an operator for selecting patterns, loading information into memory and for starting the programme/Dobby machine.

Figure 11:
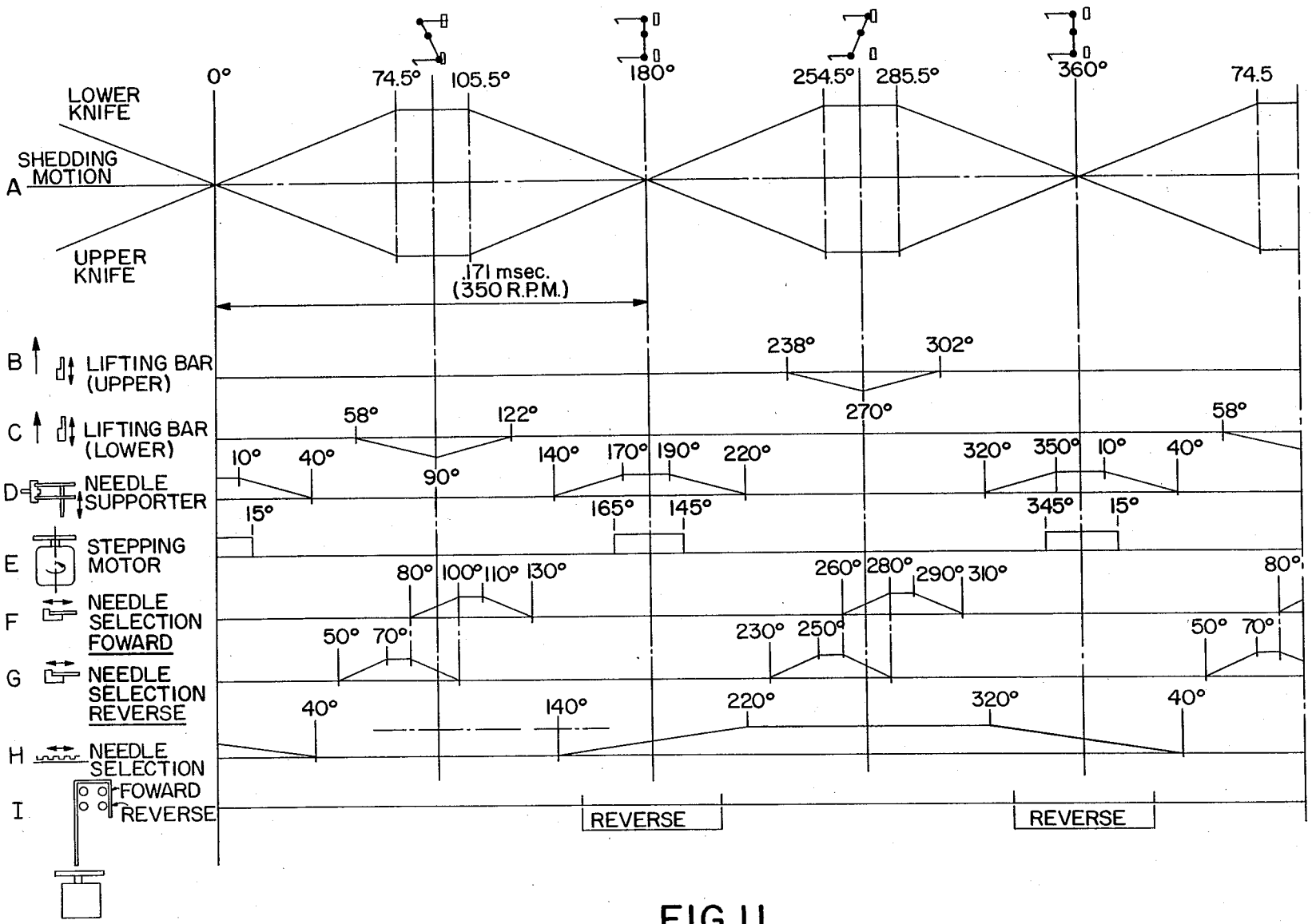
FIG. 11 is a timing diagram for the Dobby mechanism to which the Jacquard emulator, is attached.

FIG. 11 show the Dobby timing diagram for the Dobby machine. Line A represents the shedding motion; line B indicates the movement of the upper lifting bar; line C represents the movement of the lower lifting bar; line D indicates operation of the needle supporter; line E shows the operational timing of the stepping motors; line F represents the forward needle selection timing; line G represents the reverse needle selection timing; line H represents needle selection and row I represents direction selection timing.

As can be seen from line E, the stepping motors may be operated only between 165° and 195° and between 345° and 15° of the machine cycle. During these times, the needles are supported in the retracted position by the needle supporter which retracts the needles as shown in line D. The needles must be retracted when the stepping motors are operated to select the next hole pattern (programme data) to avoid damage to the Jacquard pins (needles).

The advantage of the present invention over previous devices relates to the increased reliability and efficiency of the device. Normally, as the speed of the mechanism increases (as it needed to attain higher output figures thus reducing the unit cost per output item), reliability decreases. The prior art drum controller suffers greatly from too much inertia to obtain the speed attainable by the disk controller. The use of stepping motors is vastly more reliable than solenoids when used over the enormous number of cycles experienced within this industry.

While a specific embodiment of the invention has been shown and described in detail to illustrate the application of the principles of the invention, it will be understood that the invention may be embodied otherwise without departing from such principles. In particular, the Jacquard emulator may be applied to Dobby machines having any number of Jacquard pins and any number of Jacquard pins may be actuated by the disks. Also, the number of disks and stepping motors may be varied to suit the individual applications.

Figure 12:
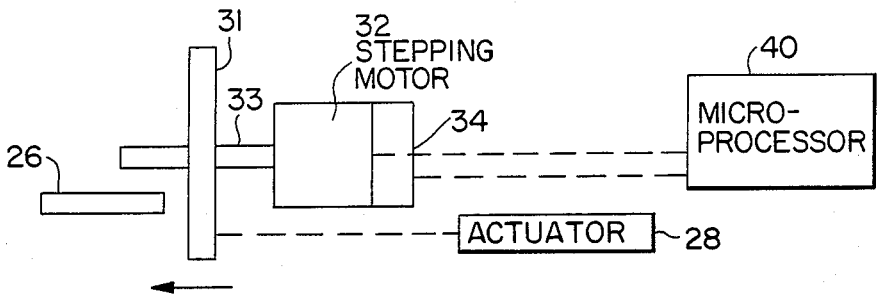
FIGS. 12 and 13 illustrate a further embodiment in which the disks of the Jacquard emulator slide along the shaft of the respective stepping motors to actuate the Jacquard pins.
Figure 13:
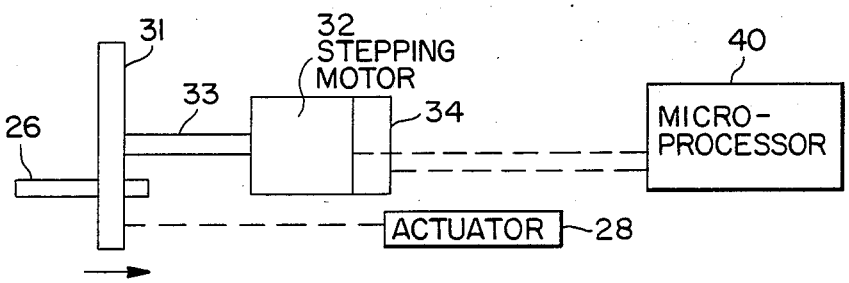

In machines using a Jacquard mechanism in which the pins are held stationary and the Jacquard card is moved to actuate various predetermined combinations of the pins, the disks may be arranged to slide along the shaft of their respective stepping motor by the card presenting mechanism or actuator of the Jacquard mechanism to operate the predetermined combinations of pins as shown in FIGS. 12 and 13. By this arrangement, the disks only are moved keeping the inertial mass to a minimum.

We claim:

1. Apparatus, for use in a textile machine having a Jacquard mechanism of the type having elongate pins extending along a mutually parallel pin axis and terminating in pin ends, for actuating predetermined patterns of the pins in accordance with program data, said apparatus comprising:

at least one disk mounted on a respective shaft for rotation about a shaft axis which extends parallel to the pin axis;

said at least one disk having a face which is position adjacent the pin ends and which is formed with axially extending holes arranged at predetermined locations; and means for rotating said at least one disk about the shaft axis to orientate the at least one disk such that the holes are aligned with predetermined ones of the pin ends in accordance with the program data.

2. The apparatus as recited in claim 1, wherein the control means comprises a respective at least one stepping motor controlled by a microprocessor, the microprocessor having a memory for storing the program data and controlling the orientation of the at least one disk in accordance with the programme data held in its memory.

3. The apparatus as recited in claim 2, wherein the orientation of the at least one disk is determined by a respective at least one sensing element of the optical type having a sensing element housing enclosing a sensing element disk attached to the shaft of the respective stepping motor and a sensing element detector mounted relative to the stepping motor.

4. An apparatus as recited in claim 2, wherein the microprocessor is connected to a display for displaying information for an operator;

a keyboard for allowing an operator to enter commands for the microprocessor;

a computer disk drive for storing and retrieving information; and a connection to allow the microprocessor to be connected to a computer for the interchange of information therebetween.

5. The apparatus as recited in claim 2, wherein the microprocessor has an output for controlling the textile machine.

6. The apparatus as recited in claim 3, wherein the at least one sensing element provides an input to the microprocessor indicating the orientation of the at least one disk and the microprocessor compares this information with the desired orientation of the at least one disk and controls the at least one stepping motor to orientate the at least one disk in the desired orientation.

* * * * *